United States Patent [19]

Sanders

[11] 4,402,094

[45] Sep. 6, 1983

[54] SAFETY CIRCULATION SYSTEM

[76] Inventor: John T. Sanders, 1441 Calle Pimiento, Thousand Oaks, Calif. 91360

[21] Appl. No.: 359,578

[22] Filed: Mar. 18, 1982

[51] Int. Cl.[3] ..... E04H 3/16; E04H 3/18; E04H 3/19

[52] U.S. Cl. ..... 4/504; 4/507; 4/541; 4/544

[58] Field of Search ..... 4/541, 542, 492, 490, 4/506, 507, 504, 508, 509, 544; 128/66; 210/221.2, 169

[56] References Cited

U.S. PATENT DOCUMENTS

| | | | |
|---|---|---|---|
| 3,377,632 | 4/1968 | Peterson | 4/490 |
| 3,483,863 | 12/1969 | Vane | 128/66 |
| 3,902,202 | 9/1975 | Strange, Jr. | 4/504 |
| 3,940,807 | 3/1976 | Baker et al. | 4/504 |
| 3,986,217 | 10/1976 | Doerr et al. | 4/542 |
| 4,262,371 | 4/1981 | Berry et al. | 4/542 X |
| 4,320,541 | 3/1982 | Neenan | 4/542 X |
| 4,335,854 | 6/1982 | Reynoso | 4/542 X |
| 4,339,833 | 7/1982 | Mandell | 4/541 X |
| 4,340,039 | 7/1982 | Hibband et al. | 4/542 X |

*Primary Examiner*—Henry K. Artis
*Attorney, Agent, or Firm*—R. P. Egermeier

[57] ABSTRACT

A liquid circulation system having a tank or tub of liquid and an external recirculation pump with one or more suction ports in the tank, and a submerged return port from the pump, having each suction port adjacent to, and preferably annular to, a return port. The entrapment of large objects in the suction port or ports is prevented by close proximity between the suction and return ports, particularly when the return flow constitutes a high-velocity jet as in hot tubs or spas.

8 Claims, 10 Drawing Figures

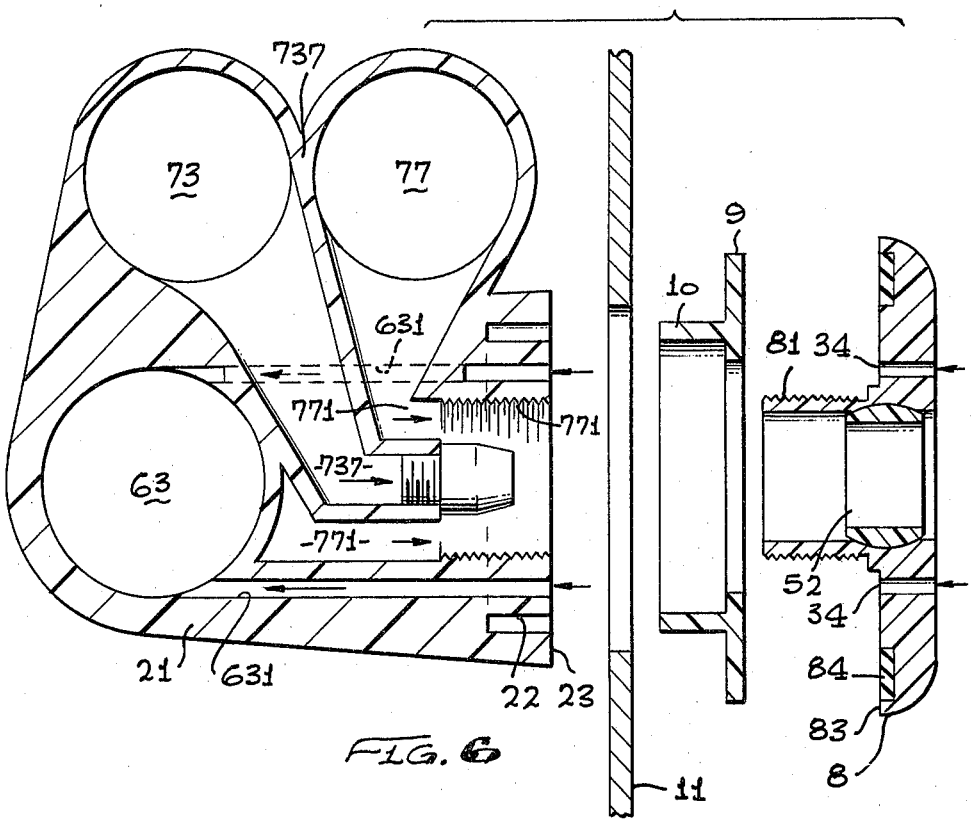
FIG. 6
FIG. 10
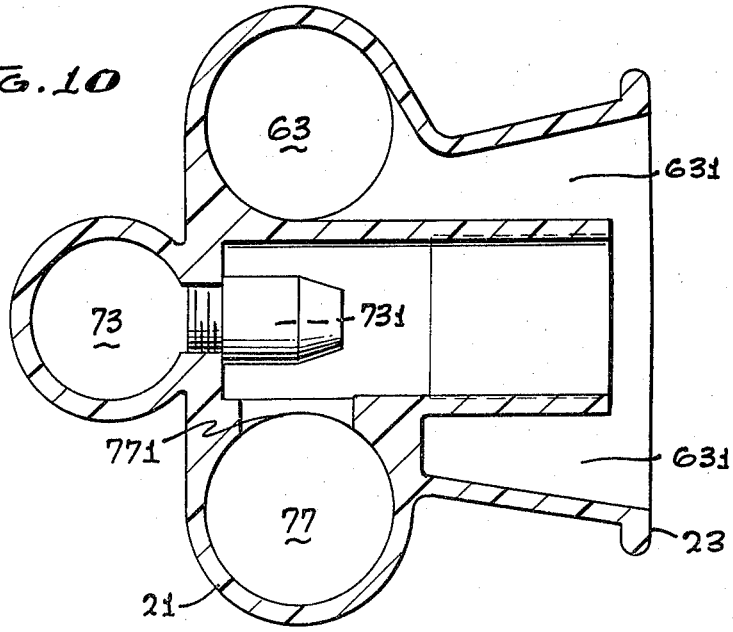

SAFETY CIRCULATION SYSTEM

BACKGROUND OF THE INVENTION

1. Technical Field

The present invention relates to circulating liquid systems having a tank or tub of liquid and a recirculating pump, with one or more suction ports in the tank, and using one or more submerged return ports from the pump. The piping between tank and pump may also contain a heater, and the return line may have provision for an injector nozzle to entrain air or other fluid. One application particularly envisioned is the commonly used hot tub, or spa, for bathing. A number of accidents have occurred in hot tubs, where the powerful suction which is associated with the high flow requirements of these tubs has held persons underwater. There is thus a need for a system which avoids the capture of objects within the tub by the suction port.

2. Background of the Prior Art

Prior art liquid circulation systems of the type considered here have employed multiple suction ports, distributed about the tank, and connected in parallel to the pump. Use of multiple suction ports promoted better mixing of liquid, by drawing from all ports of the tank. More importantly to the hot-tub application, the full power of the pump is divided among the multiple suction ports, thereby reducing the chance that a body may be drawn to a suction port and held tightly. However, there have been continuing instances of persons drowning because hair or loose clothing was drawn into one of multiple suction ports and held too tightly to be removed by the individual. Hair and clothing items are particularly vulnerable to such occurrences because they do not completely block the flow and are thus subjected to high dynamic pressures associated with the high flow velocities used in hot tubs, even with multiple ports. Furthermore, the use of multiple suction ports is undesirable because of the proliferation of openings through the tank wall. Each such opening is a potential leak, and contributes to weakening of the wall. In principle, multiple suction ports could provide sufficient distributed area to assure that suction flow at the tank wall avoids any possibility of accident, but practical applications do not usually achieve the desired objective. The same considerations apply to industrial mixing systems which are unreliable with the external pump system considered here when the tank contains floating solid objects.

SUMMARY OF THE INVENTION

The present invention provides a safety circulation system wherein the energy of the return flow to the tank is used to help prevent trapping of objects in the suction line, by placing the suction port immediately adjacent to the return port, and preferably annularly disposed about the return port. When multiple return ports are used, the total suction port area is divided proportionately among all the return ports.

In good practice, the area of the suction port is greater than the area of the discharge port, so that flow velocities are higher in the return port, tending to push objects away. This effect is more pronounced as circulation velocities are increased, and as the return flow is used to form a jet, which normally penetrates a considerable distance into the tank. The jet configuration is employed in hot tubs, with multiple return jets. The present invention provides a further advantage in hot tubs in that persons tend not to occupy the position immediately in front of the return jets because of discomfort. With the present invention, being displaced from the return jets assures displacement from the suction lines. Still further, if a body could block the annular section port, the associated return port would also be blocked, reducing the flow velocity in the system, and producing full reaction pressure against the trapped body. Preferred implementations are disclosed having suction and discharge ports integrated into a single fitting, so that only one hole in the tank wall is required in order to provide both suction and discharge. In applications employing multiple return ports, as is usual in hot tubs, the advantage of multiple suction ports is provided without any separate suction port holes.

BRIEF DESCRIPTION OF THE DRAWINGS

FIG. 6 shows a unitary assembly incorporating both suction and return ports for installation in a single opening in a tank wall.

FIG. 10 shows an alternative outer assembly for a safety suction jet.

DESCRIPTION OF THE PREFERRED EMBOIMENTS

Figure 1:
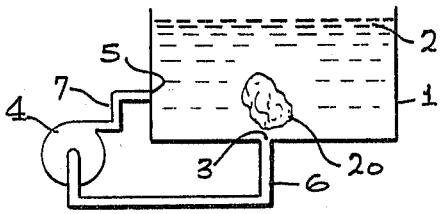
FIG. 1 PRIOR ART
FIG. 1 is a schematic diagram of a circulating liquid system.

Conventional liquid circulation systems as exemplified by the schematic of FIG. 1 are employed for mixing, for maintaining mixtures and suspensions, and in large numbers for hot tubs for bathing and for therapeutic purposes. FIG. 1 identifies the basic elements of the circulating system: tank, or tub, 1; liquid surface 2; suction port 3; pump 4; submerged return port 5; piping 6 from suction port to pump; and piping 7 from pump to return port. In many industrial systems the return port is not submerged; such systems are not considered here. The system of FIG. 1 suffers from an operating deficiency in that any submerged body 20 may be drawn to suction port 3 and held there. Even with the flow blocked, the pump section force will continue. This deficiency represents a particular danger to persons using hot tubs and has resulted in numerous drownings. The danger is exacerbated by loose clothing or long hair and by the high horsepower pump ratings which are employed. Attempts to reduce the danger by employing separated multiple parallel-connected suction ports have been only partially successful, because of the strong suction, and some accidents continue to occur. The hot tub industry, in particular, has been seeking some means of alleviating the danger associated with the suction port, while retaining the vigorous circulation.

Figure 2:
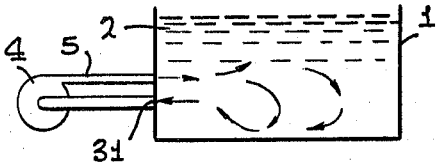
FIG. 2 is a schematic diagram of a safety circulating liquid system employing the present invention.

The elements of the present invention are set forth in FIG. 2, which is a schematic of a liquid circulation system like that of FIG. 1, except that the suction port 31 is located immediately adjacent to return port 5. In FIG. 2, flow in the tank is illustrated. With a high return flow velocity, particularly the aerated jets employed in hot tubs, and with suction port area significantly larger than the return port area, the flow from the inlet port directly to the suction port will be insignificant. However, any submerged body which is drawn to the suction port will experience a repelling force from the return flow. The repelling force will be greater than the suction force because of the velocity of the jet. Consequently, the submerged body will be driven away, and cannot be held to the suction port. Even if hair or loose clothing items are drawn along the tank wall to the suction port, the body to which they are attached will be eventually pulled in front of the adjacent return port, with its greater repelling foce. Furthermore, if the suction port should somehow be blocked by a body of any size, the return port would also be blocked, stopping the flow altogether.

For these reasons, the present invention provides a safety circulation system. Concentric ports are identified as a preferred means for producing this result. A further safety measure can therefore be provided by including a flow sensor in the piping, to shut off the pump when flow ceases.

Figure 3:
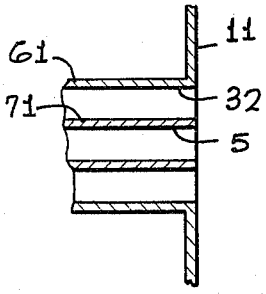
FIG. 3 is a detail of the installation of the present invention.
Figure 4:
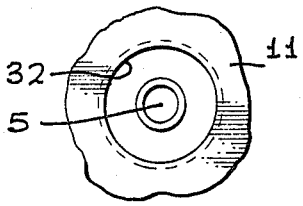
FIG. 4 is a front surface view of the installation of FIG. 3.

FIGS. 3 and 4 exemplify the use of concentric suction and return ports in the safety circulation system wherein the return port 5, connected to pipe 71, is surrounded by annular suction port 32 connected to pipe 61 concentric with pipe 71, with the concentric ports coming through a single opening in tank wall 11. The annular arrangement of FIGS. 3 and 4 permits the suction area to easily be made greater than the return area, with the return area forming a high velocity jet, and makes it impossible to cover the suction port without covering the return port. Since the suction port must be submerged, the application is necessarily restricted to submerged return jets.

Figure 5:
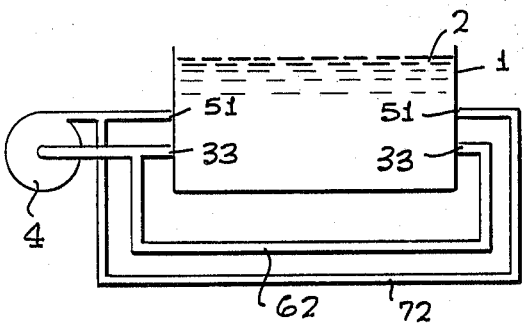
FIG. 5 is a schematic diagram of a circulating liquid system employing multiple ports with the present invention.

FIG. 5 is still another schematic of a circulating liquid system having tank or tub 1 and pump 4, but with multiple suction ports 33 manifolded together and connected to the pump by piping 62 and multiple return ports 51 manifolded and connected to the pump by piping 72. In FIG. 5, the multiple suction ports are shown adjacent to the return ports as set forth in the present invention. If multiple suction ports are used, not adjacent the return ports, especially full flow will continue when one suction port is blocked, with a slight increase in suction pressure. Thus, the full advantage of such dispersed suction ports cannot be realized unless the total suction area is made extremely large, with correspondingly large suction piping to keep suction velocity very low. In the present invention, no suction ports are to be provided except those adjacent to the return ports, and every return port should be provided with a suction port. Preferably, the total suction area should be proportionately divided among all of the return ports which are used.

FIG. 6 illustrates a safety suction jet employing the present invention, having the suction and return ports integrated into a single assembly for installation through a single hole in the tank wall 11. The assembly provides pipe connections 63 and 73 for suction and return piping, respectively. Also included for illustration is pipe 77, which, acting with the return line, forms an air injector driving an aerated jet through the return port. Although air line 77 and the air injector action are not essential parts of the present invention, they are typically employed in hot tub return jets and therefore provision is made for their incorporation. The assembly consists of inner flange 8, containing return port 52, and having a threaded tubular extension 81 surrounding the return port 52. Extension 81 may be threaded internally or externally, as desired, although external threads are shown. Provision may also be made for including means to direct the return flow relative to the surface of the flange. Such directing means are well known in the art, and are commonly used in spa jets. Surrounding the tubular extension are multiple suction ports 34 extending through flange 8 and annularly disposed with respect to return port 52. The back side of flange 8 provides a sealing surface 83 at a radius beyond the outer extent of the suction ports 34, and also includes sealing groove 84. An outer assembly 21 contains three concentric tubes 631, 731, and 771. The outermost tube 631 is conducted to suction pipe fitting 63. The innermost concentric tube 731 is sealingly conducted through the wall of tube 631 and joined to return pipe fitting 73. The intermediate inner concentric tube 771 forms an annulus about tube 731 and is sealingly connected through the wall of tube 631 to air pipe 77. Tubes 731 and 771 are shown as being formed with a common wall 737 to save material. As already mentioned, the use of an air injector is optional. When the injector is not used, the inner concentric tube is the return jet. In either case, the second tube in is threaded to accept the threads from the threaded tubular extension 81 on the inner flange. The outer concentric tube 631 is of sufficient diameter to accept the entire cross-sectional area of suction ports 34, and will be aligned with ports 34 when the above-mentioned threaded portions are engaged. The end of outer tube 631 which will face the flange is broadened sufficiently to provide sealing surface 23 for sealing to the tub wall, and includes annular sealing recess 22. Sealing ring 10 has a diameter greater than the greatest diameter encompassing all of the suction ports 34, and will be sealed into recess 22 by compression when the threaded tubular extension 81 is engaged with the threaded inner tube and fully secured, recess 22 being slightly tapered for the purpose. Ring 10 is also to be sealed to the facing surface of flange 8. To save depth in the flange, the implementation of FIG. 6 provides for a washer or flat ring 9 integral with ring 10. Ring 9 is sized to sealingly fit into recess 84 in flange 8, being sealed by compression. In practice, sealing of process 22 and 84 is promoted by application of any standard plastic sealing or gasket-forming material. Inner flange 8 is positioned inside the tank, with the tubular extension 81 protruding outward through an appropriate opening in tank wall 11. Sealing ring 10 is installed intermediate the flange and the outer assembly, which is brought up to the outside of the tank wall. The threaded portions are engaged and tightened until sealing surfaces 83 and 23 form a sealed connection with the tub wall surrounding the opening therein. The depth of recess 22 is made greater than the depth of ring 10 to assure that the tapered seal formed thereby does not prevent formation of an adequate seal to the wall 11. The details of selecting thickness and depth of rings 9 and 10 and recesses 84 and 22 for this purpose are well known.

Figure 7:
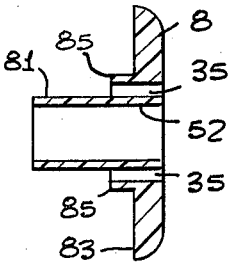
FIG. 7 shows a front surface view of an inner flange for use with a unitary assembly like that of FIG. 6.

The use of ring 10 is optional in the integrated assembly. Its purpose is to provide a separate seal for the suction passage which would otherwise include the edge of the hole in the wall of tub 11, and also to align the assembly so that the tub wall does not block any of ports 34. Where the wall of the tub can be exposed to the liquid, ring 10 need not be used. However, other means must then be provided to assure that the assembly is sufficiently well centered in the hole through the tub wall to avoid blockage of the suction ports. FIG. 7 illustrates, in cross-section, an alternative flange part 8 which may be used with the assembly of FIG. 6 when ring 10 is not used. In FIG. 7, suction ports 35 are annularly distributed about return port 52, as shown for example in FIG. 8. Located at a greater radius than ports 35 are alignment pins 85. Two such diametrically opposed pins 85 are sufficient to assure adequate centering of flange part 8 in a round hole in the tank wall, so that none of ports 35 are blocked by the wall. More than two pins 85 may be used, and they may have any convenient cross-section, or may form a continuous ring. The height of alignment pins 85 must be less than the thickness of the tub wall, so that no compressive force is carried by the pins. With the flange part of FIG. 7, recesses 22 are not required in the outer body assembly.

Figure 8:
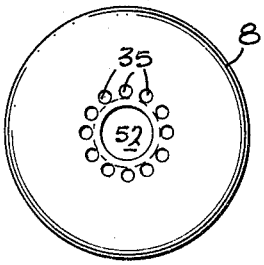
FIG. 8 shows a sectional view of an alternative inner flange for use with a unitary assembly like that of FIG. 6.

FIG. 8 shows a view from inside the tub of one typical version of flange part 8. The reference numerals 35 for suction ports and 52 for the return port conform to the notation of FIG. 7. However, the face arrangement shown in FIG. 8 can also be used with the design of FIG. 6. Ports 35 can have alternative shapes, at the choice of the designer, although round ports may be most convenient to fabricate. Furthermore, there must be sufficient flange material between the ports to transmit the clamping force from threaded extension 81 to sealing surface 83 so as to form a liquid-tight seal at the tub wall.

Figure 9:
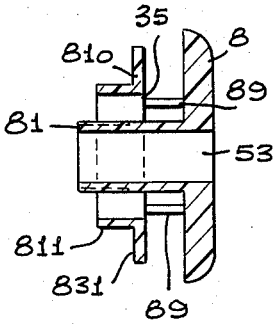
FIG. 9 shows a sectional view of another alternative inner flange for use with a unitary assembly like that of FIG. 6.

FIG. 9 illustrates a further alternative implementation for the inner flange part 8, providing an annular suction port which will draw fluid parallel to the tank wall, at right angles to the return jet. In FIG. 9, threaded extension 81 is surrounded by annular ring 810 characterized by sealing surface 831 which provides the required seal to the tank wall. Posts 89 transmit the clamping force to the annular ring 810 and thence to surface 831. These posts must be of sufficient cross-section to transmit the torque associated with sealing. They may be replaced by, or supplemented with, radial spacers not shown between extension 81 and ring 810. Projection 811 on ring 810 provides the alignment function in the tank wall, and may be shorter than the thickness of the tank, or tub, wall. Alternatively, 811 may be a projecting ring analogous to ring 10 in FIG. 6, sealing with recess 22 to exclude the liquid from contact with the tank wall.

The components employed for fabrication of the safety suction jet assembly as illustrated in any of FIGS. 6 through 9 may be made of metal, or any suitable plastic. It is anticipated that, for hot tub use, plastic molding will be employed, as is common with prior art spa jets. Any of the plastics commonly used for solvent-welded hot water plumbing service can be used, with price and appearance as factors of choice. Return flow nozzle features providing control over the direction of flow are known in the prior art, and may be incorporated into inner flange part 8. Likewise, the exact details of forming an injector nozzle between coaxial tubes 731 and 771 illustrated in FIG. 6 may vary. The end of tube 771 may be formed for the purpose, or a separate nozzle part may be secured on the end of the tube. Because of the high pressures employed in spa pumps, one-piece molding or threaded assembly is preferred, as indicated in FIG. 6. Solvent welding is suitable for bonding piping 6, 62, 7, or 72 to the unitary assembly.

FIG. 10 illustrates an alternative, and somewhat simpler, embodiment for outer assembly 21 of the unitary safety suction jet assembly. Reference numerals in this implementation corrspond to those of FIG. 6, and any of the flange part embodiments which are shown and discussed herein may be employed with this outer assembly. In FIG. 10, inner concentric tube 731 is shown as a screwed-in injector nozzle, as previously described.

Although the invention has been described in terms of specific embodiments thereof, it should be realized that various changes and modifications may be made therein without departing from the spirit and scope of the invention.

What is claimed is:

1. A safety circulation system in a circulating liquid system having a tub or other container of liquid, at least one suction port in the tub and connected by piping to the pump, and a return line from the pump to at least one submerged return port in the tank, the invention comprising: the suction port being arranged as an outer annulus about a return port and adjacent thereto, whereby blockage of the suction port results in simultaneous blockage of the adjacent return port, thereby reducing the flow requirement to said suction port.

2. A safety suction jet for use in a circulating liquid system having a tub of liquid and a pump receiving liquid from at least one suction port and returning liquid to at least one submerged return port in the tub through piping connecting the pump to the respective ports, wherein each suction port is integrated into a single assembly with an adjacent return port for installation through a single hole in the tub wall, with separate piping connections outside the tub wall for suction and return connection to the pump, comprising: an inner flange having a tubular threaded extension, said flange having a central port opening to the interior of said tubular extension and having multiple outer ports opening through said flange outside said tubular extension, said multiple ports being arranged annularly about said extension, said flange extending beyond said outer ports to provide a sealing surface for the inner surface of the tub wall; and an outer assembly compriding two concentric tubes, the inner of said concentric tubes being threaded to accept said threaded tubular extension of said flange, the outer of said concentric tubes being of sufficient diameter to encompass said outer ports in said flange and the end of said outer tube providing a sealing surface for the outer surface of the tub wall, said outer concentric tube being connected to the pump suction line, and said inner concentric tube is sealingly conducted through the wall of said outer tube and connected to the return line from the pump, the single hole in the tub wall being larger in diameter than the outer diameter encompassing said suction ports and smaller than the smallest outer diameter of said flange and said concentric outer tube, said inner tube being installed inside the tub with said threaded tubular extension projecting outwardly through the tub wall, and secured to said outer assembly by engagement of said threaded tubular extension with the threads of said inner concentric tube, said threaded engagement providing sufficient pressure to abuttingly seal said flange and said outer concentric tube respectively to the inner and outer surfaces of the tub.

3. The safety suction jet as claimed in claim 2, wherein said inner flange further comprises at least two integral alignment pins parallel to said tubular extension, the outer extremity of said alignment pins being located at a greater diameter on said flange than that diameter which contains the outer extent of said annularly-arranged suction ports whereby, when said flange is installed with said tubular extension through the tub wall, said alignment pins also project into the opening in the tub wall so that said flange cannot be sealed to the tub wall in such position that any of said suction ports are blocked by the wall.

4. The safety suction jet as claimed in claim 2, wherein: said inner flange further comprises an outer tubular extension disposed coaxially with said threaded tubular extension, the outer diameter of said flange being greater than the outer diameter of said outer tubular extension; said suction ports open into the annulus between said tubular extensions; and said outer concentric tube is recessed to sealingly receive said outer tubular extension, whereby, when assembled through the tub wall, the flow through said suction ports is conducted to said outer concentric tube in isolation from the edges of the tub wall.

5. The safety suction jet as claimed in claim 2, further comprising: a sealing ring having a diameter greater than the greatest diameter encompassing said annularly-arranged suction ports and less than the outer diameter of said flange, the surfaces of said flange and said outer concentric tube which abut the tub wall are each arranged to sealingly receive said sealing ring, said abutting surface of said flange being further arranged to align said ring outside said suction ports whereby, when said threaded tubular extension is secured to said inner concentric tube, the abutting surfaces of said flange and said outer tube are sealed to the tub wall and said sealing ring is further sealed to said flange and to said outer tube, providing a closed passage from said suction ports to said outer tube.

6. The safety suction jet as claimed in claim 3, 4, or 5, the outer assembly further comprising a third concentric tube located inside the threaded inner tube, wherein said third concentric tube is sealingly conducted through the walls of the other said concentric tubes and is to be connected to the pump return, and the annular space between said third tube and said threaded inner tube is openable to the atmosphere, said third concentric tube having a nozzle inside said threaded tube, forming an air injector.

7. The safety suction jet as claimed in claim 6, installed in the circulating system of a hot tub for bathing.

8. A safety circulation system in a circulating liquid system having a tub or other container of liquid, multiple suction ports in the tub and connected by piping to a pump, and a return line from the pump to at least one submerged return port in the tank, the invention comprising: arrangement of the suction ports in one or more rings, each said ring disposed annularly about and adjacent to a return port, said multiple suction ports in each ring being connected together outside the tank, whereby blockage of said suction ports results in simultaneous blockage of the return port, thereby reducing the flow of liquid to said port.

* * * * *